US006024189A

United States Patent [19]

Heuser

[11] Patent Number: 6,024,189

[45] Date of Patent: Feb. 15, 2000

[54] NOISE ATTENUATING APPARATUS

[76] Inventor: Stephen G. Heuser, 55826 60th Ave., Lawrence, Mich. 49064

[21] Appl. No.: 08/915,446

[22] Filed: Aug. 20, 1997

[51] Int. Cl.[7] ..... F01N 1/08

[52] U.S. Cl. ..... 181/264; 181/230; 181/281

[58] Field of Search ..... 181/264, 268, 181/269, 270, 273, 275, 276, 281, 282, 230

[56] References Cited

U.S. PATENT DOCUMENTS

| | | | |
|---|---|---|---|
| 1,081,348 | 12/1913 | Unke . | |
| 1,084,883 | 1/1914 | Holzwarth | 181/264 |
| 1,760,924 | 6/1930 | Watkins . | |
| 2,373,231 | 4/1945 | Demuth | 181/264 |
| 2,609,886 | 9/1952 | Harmon . | |
| 4,574,914 | 3/1986 | Flugger | 181/268 |

FOREIGN PATENT DOCUMENTS

| | | |
|---|---|---|
| 216 065 | 5/1924 | United Kingdom . |
| 364 222 | 1/1932 | United Kingdom . |

OTHER PUBLICATIONS

Copy of International Search Report dated Dec. 2, 1998 from PCT/US98/17453.

*Primary Examiner*—Khanh Dang
*Attorney, Agent, or Firm*—Flynn, Thiel, Boutell & Tanis, P.C.

[57] ABSTRACT

A sound attenuating device is provided for use in reducing sound levels associated with a sound source, such as an internal combustion engine. The noise attenuating device, for example, is connected to the exhaust pipe of the engine and receives sound waves and a fluid flow of exhaust gas therefrom. The sound attenuating device includes a housing which defines an interior chamber, an inner deflector assembly extending centrally through the chamber, and a diverter arrangement near an inlet of the housing. The inner deflector assembly is formed from a longitudinal stack of spaced apart tapered deflectors such as inner cones which extend centrally through the chamber and define an annular passage radially between the inner cones and the housing wall. The diverter arrangement diverts the fluid flow to the annular passage. As a result, a relatively free flow of the fluid is permitted through the passage while sound waves are deflected between the housing and the surfaces of the inner cones whereby sound levels are attenuated.

20 Claims, 6 Drawing Sheets

NOISE ATTENUATING APPARATUS

FIELD OF THE INVENTION

This invention relates to a noise attenuating apparatus and in particular, to a muffler for reducing the sound level generated by a noise or sound source such as an internal combustion engine.

BACKGROUND OF THE INVENTION

A noise attenuating apparatus such as a muffler typically is used on noise sources to reduce the decibel levels or sound levels being generated thereby. For example, one common type of noise source is an internal combustion engine used on vehicles or power implements such as a lawn mower, snow blower, generator or the like. Such internal combustion engines typically generate noise at a high decibel level and a muffler is used on the engine exhaust. The muffler attenuates or reduces the sound levels to a level which is acceptable for an operator and/or the environment in which the noise source is being used.

For example, U.S. Pat. No. 4,415,059 (Hayashi) discloses a muffler for sound damping which has expansion chambers therein as well as additional chambers which surround the expansion chambers.

In a further example, U.S. Pat. No. 700,785 (Kull) discloses a muffler having a plurality of frusto-conical cones which are perforated to allow for the passage of the exhaust gases through the cones.

U.S. Pat. No. 2,919,761 also discloses a muffler having a plurality of expansion chambers which are separated one from the other by intermediate baffles that are formed with a plurality of orifices or openings therethrough so as to impose relatively little back pressure on the engine.

Additionally, U.S. Pat. Nos. 4,105,090 (Tachibana et al), 4,416,350 (Hayashi), 4,595,073 (Thawani), 4,635,752 (Jennings), 4,637,491 (Fukuda) and 5,378,435 (Gavoni) disclose further examples of mufflers.

While the above-identified prior art mufflers may be satisfactory for attenuating the sound levels generated by various internal combustion engines, the invention disclosed herein relates to an improved sound attenuating device which attenuates or reduces sound levels to an acceptable level while avoiding excessive increases in the back pressure on the medium or fluid being attenuated.

In particular, the invention relates to a noise attenuating device having a hollow housing through which the fluid being attenuated can flow. The housing includes an arrangement of tapered sound attenuators within the hollow interior which reduce the sound levels associated with sound waves and the fluid flow. The noise attenuating device of the invention not only reduces the sound levels but accomplishes the sound level reduction while providing a relatively large passage which extends along the length of the housing to allow the fluid to flow freely therethrough and avoid excessive increases in back pressure.

More particularly, the housing is axially elongate and has an inlet at one end thereof and an outlet at the other end thereof. The inlet is connected to the sound source such as an internal combustion engine for receiving the fluid flow and/or sound waves such that the fluid flow enters the interior chamber of the housing and passes therethrough to the outlet.

To reduce the noise levels associated with the fluid flow, the noise attenuating assembly preferably includes a diverter arrangement near the inlet end, and an inner cone or deflector assembly formed from a stack of tapered deflectors preferably formed as inner cones which extend axially between the diverter arrangement and the outlet. A longitudinal passage is defined in a radial space between the outer diameter of the inner cones and the inside of the housing so that the fluid can freely flow along the outside of the inner cone assembly.

To direct the fluid flow to the passage, the diverter arrangement includes a diverter cone which tapers outwardly away from the inlet so as to deflect the fluid flow and sound waves radially outwardly to the longitudinal passage. As a result, the fluid flow and sound waves travel along the length of the housing but radially outwardly of the inner cone assembly. Thus, unlike prior art mufflers which direct fluid flow through cones, the fluid in the inventive sound attenuating device primarily flows around the inner cone assembly along the longitudinal passage.

Attenuation of sound is accomplished by reflecting the sound waves within the housing. Accordingly, the inner cones are hollow and taper inwardly toward the outlet such that the larger base of the cones is open towards the inlet. The inner cones also are axially spaced apart to permit sound waves to be deflected into and around the hollow inner cones, which thereafter are deflected toward the housing wall and vice versa. Thus, the inner cone assembly primarily functions to deflect sound waves although some fluid flow may be permitted through the inner cone assembly.

To further assist in the deflection of the sound waves, the housing includes ring-like outer cones or tapered deflectors formed on the inside of the housing to reflect the sound waves towards the inner cones. Thus, as the sound waves enter the housing, the sound waves are reflected against the inner cone assembly.

The repeated or continuous deflection of the sound waves serves to reduce the sound levels wherein standing wave forms are believed to be created by the deflection of the sound waves. The standing wave forms interact with oncoming sound waves and cause a destructive interference or resistance therebetween which reduces the sound levels. Thus, while a relatively large passage is provided for the flow of the fluid through the muffler, the deflection of the sound waves off of the inner cone assembly serves to reduce the sound levels.

While the invention preferably is formed as a muffler for use with the exhaust or another flow of a fluid therethrough, the invention also is usable with additional sound sources which generate sound waves that travel into the housing.

Other objects and purposes of the invention, and variations thereof, will be apparent upon reading the following specification and inspecting the accompanying drawings.

Figure 1:
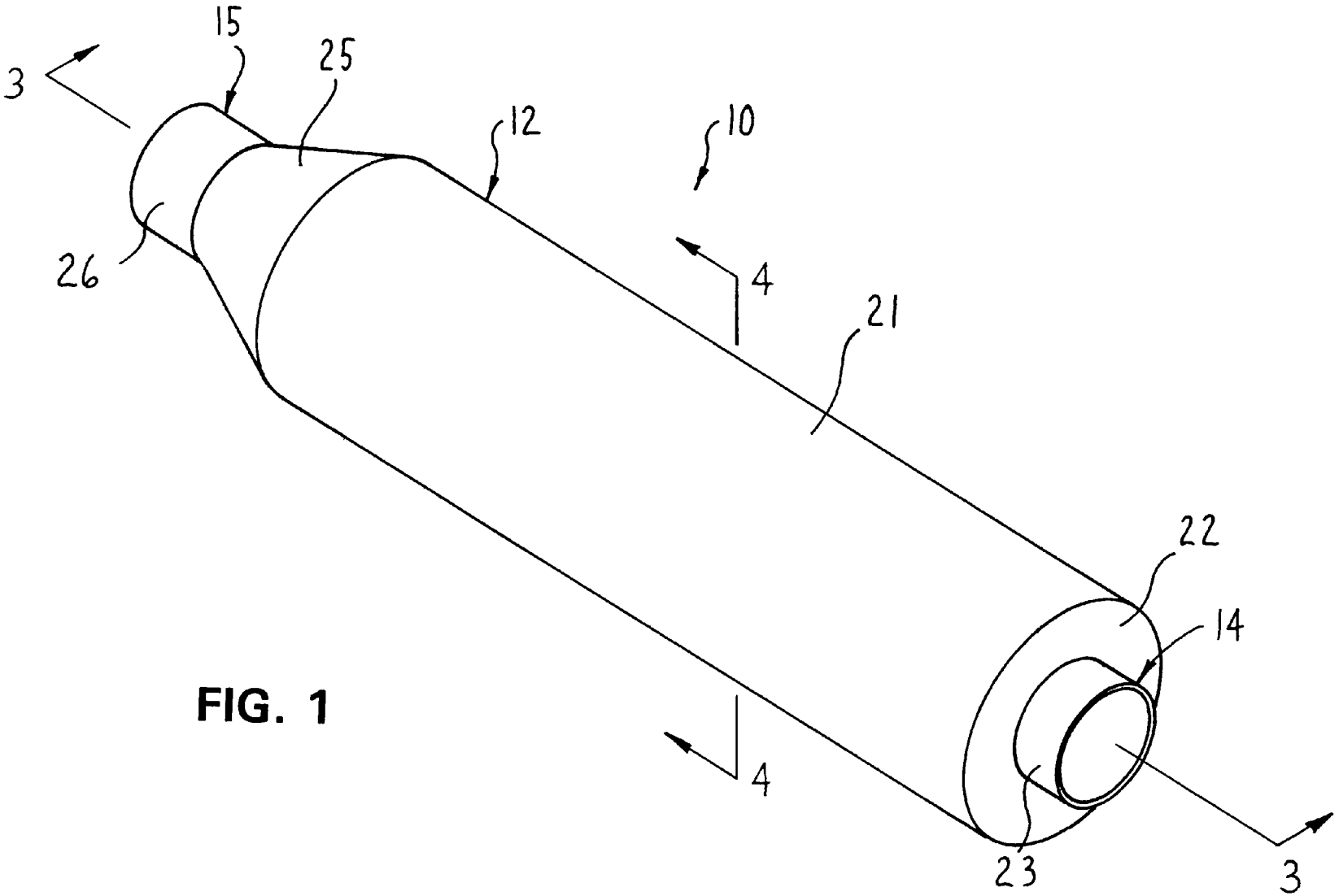
FIG. 1 is a perspective view of the noise attenuating device of the invention which is drawn to scale.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
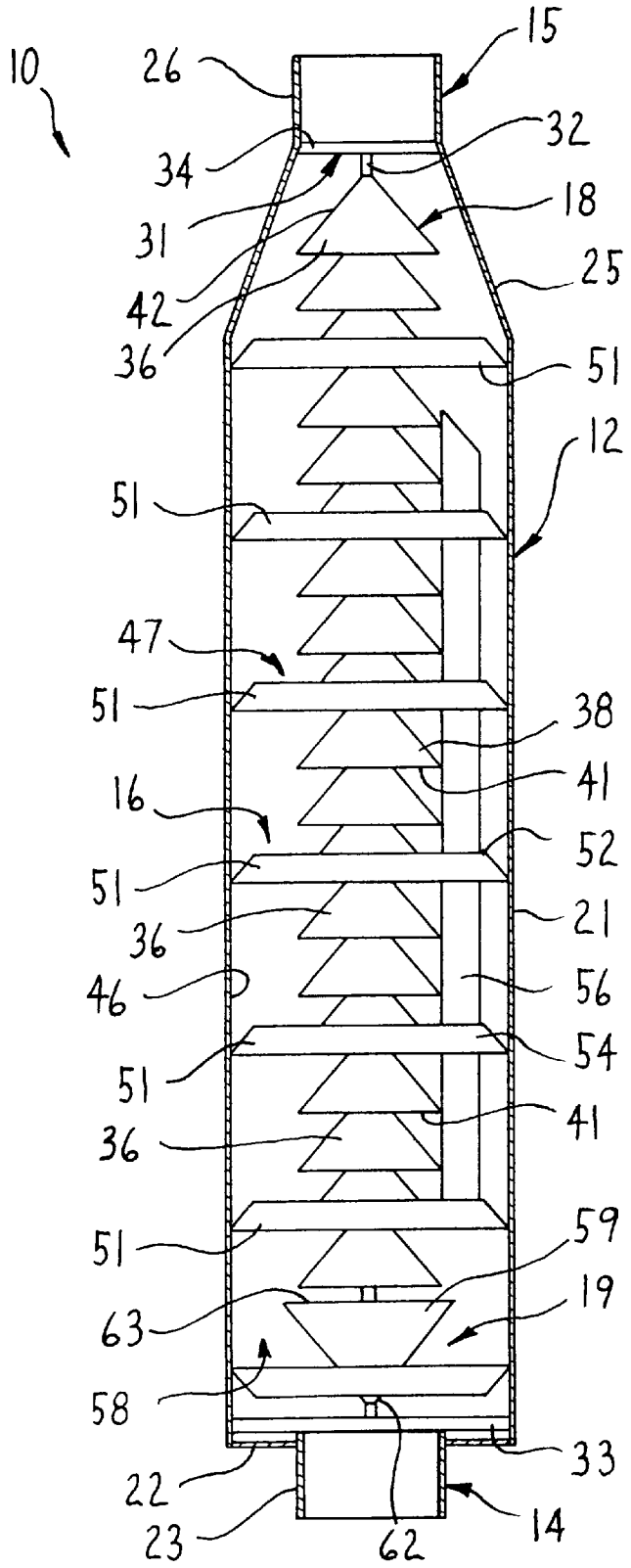
FIG. 2 is a front elevational view of the noise attenuating device illustrating the housing in cross-section.

Referring to FIGS. 1 and 2, a noise attenuating device 10 of the invention includes a hollow housing 12 which has an inlet 14 at an upstream end thereof and an outlet 15 at a downstream end thereof. The noise attenuating device 10 is adapted to operate as a muffler wherein a flow of fluid, such as exhaust gas, enters an interior housing chamber 16 through the inlet 14. The noise attenuating device also includes an inner deflector or cone assembly 18 for attenuating sound levels associated with the fluid flow, and a diverter arrangement 19 provided near the inlet 14 for diverting and directing the fluid flow along the outside of the inner cone assembly 18.

Generally, the noise attenuating device 10 is connected to an exhaust pipe (not illustrated) of an internal combustion engine (not illustrated). The internal combustion engine generates exhaust gases during use and also acts as a noise source wherein sound waves travel along the exhaust pipe. Examples of internal combustion engines on which the invention can be used include engines used on diesel trucks as well as engines used on lawn mowers, snow blowers, generators or the like. When used on the exhaust of an internal combustion engine, the exhaust gas flows into the interior chamber 16 and is diverted radially outwardly by the diverter arrangement 19 so as to flow freely along the outside of the inner cone assembly 18. The fluid flow then converges radially inwardly through the outlet 15, for example, to ambient environment.

The sound waves, however, passing into the interior chamber 16 are repeatedly reflected against the inner cone assembly 18. As a result, successive sound waves travel along paths of different lengths and directions and are believed to destructively resist or interfere one with the other such that sound levels are reduced thereby. Thus, while the fluid flow is allowed to pass relatively freely through the housing 12 such that back pressure is reduced, the inner cone assembly 18 in combination with the diverter arrangement 19 attenuates the sound levels to acceptable levels as described hereinafter.

More particularly, the housing 12 is formed from an axially-elongate cylindrical tube 21. An end wall 22 is mounted to the upstream end of the tube 21 and includes an open-ended pipe or tube 23 which extends therethrough so as to be in communication with the interior chamber 16. The tube 23 defines the inlet 14 and has a diameter which is preferably one-half the diameter of the housing tube 21.

The opposite downstream end of the housing tube 21 includes a frusto-conical or funnel-shaped converger cone 25 which tapers radially inwardly towards the outlet 15. The converger cone 25 defines the outlet 15 and supports an open-ended outlet tube 26. The outlet tube 26 is substantially the same diameter as the inlet tube 23 and is disposed in coaxial relation therewith such that the fluid being attenuated flows into the interior chamber 16 through the inlet 14 and then passes axially along the longitudinal length of the housing 12 to the outlet 15.

The noise attenuating device 10 further includes the inner cone assembly 18 which is centrally supported in the interior chamber 16 by a support frame 31.

The support frame 31 includes a central support rod 32 which extends longitudinally through the chamber 16 and is supported at its opposite ends by transverse cross rods or mounting rods 33 and 34. The cross rods 33 and 34 are fixed to the respective inlet and outlet ends of the housing 12, and extend diametrically across the inlet tube 23 and outlet tube 26 such that the central support rod 32 is coaxial therewith.

Figure 3:
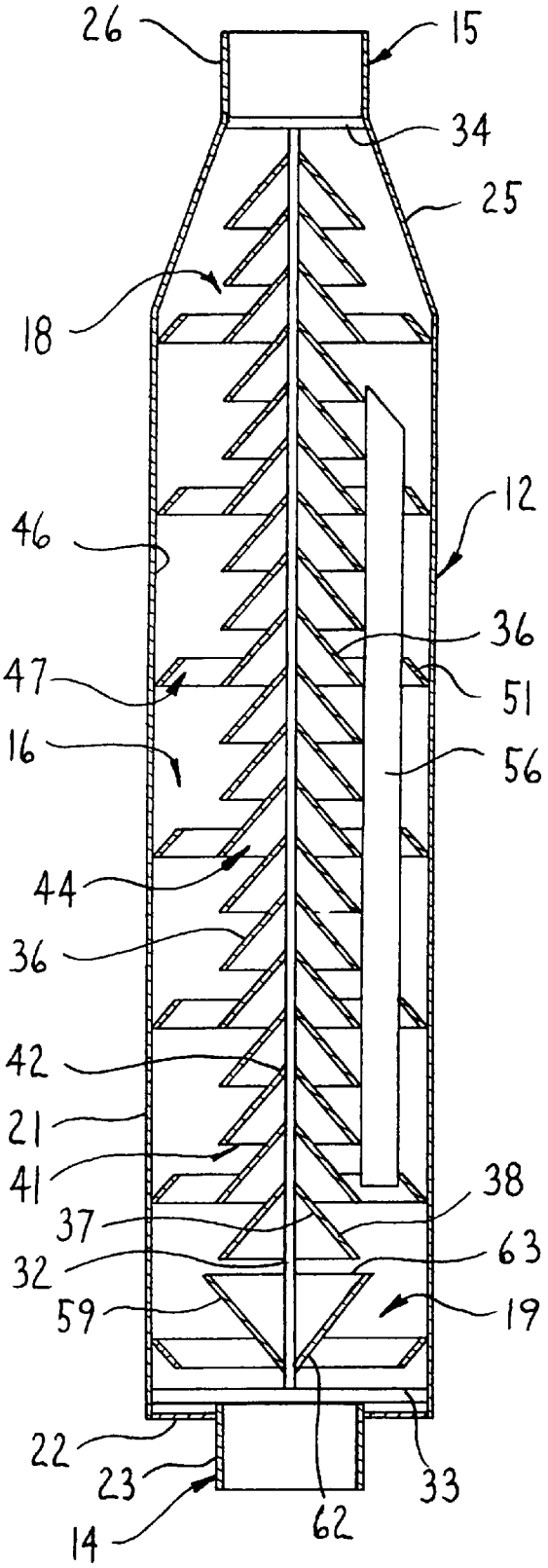
FIG. 3 is a front elevational view illustrating the housing and the internal components thereof in cross-section as taken along line 3—3 of FIG. 1.
Figure 5:
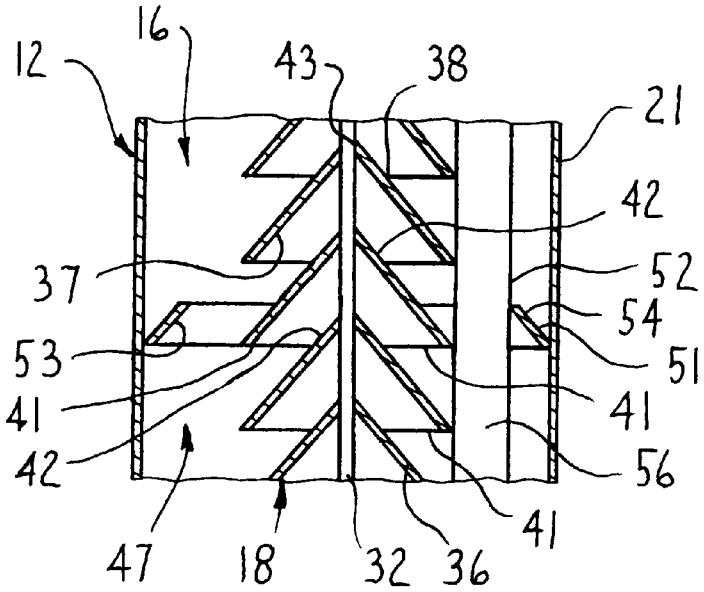
FIG. 5 is an enlarged partial view of the noise attenuating device of FIG. 3.

The inner cone or deflector assembly 18 includes a plurality of tapered deflectors which are preferably formed as inner cones 36 and are mounted to the central support rod 32 as seen in FIGS. 2, 3 and 5. In particular, the inner cones 36 are formed as cones without flare and preferably are hollow so as to define inner and outer surfaces 37 and 38 which taper radially inwardly toward the outlet 15. While the inner cones 36 are preferred, the tapered deflectors can have a different shape such as a pyramidal shape having flat sides. Each inner cone or deflector 36 therefore has an open base 41 and a narrower tip end 42. To facilitate the deflection of sound waves, the inner cones 36 preferably are imperforate so as to define closed cones although openings may be provided in the inner cones 36 so long as sufficient deflection of the sound waves occurs.

The tip end 42 of each inner cone 36 is formed with an aperture 43 (FIG. 5) which receives the central support rod 32 therethrough. During assembly, the inner cones 36 are slid one after the other onto the central support rod 32 and fixed in place such as by welding.

Preferably, the tip end 42 of each cone 36 projects into the open base 41 of an adjacent cone 36 such that the cones 36 are arranged in a nested stack extending along most of the length of the central support rod 32. Alternatively, the inner cones 36 also could be separated apart.

Therefore, the inner surface 37 of one cone 36 and the opposing outer surface 38 of an adjacent cone 36 are spaced apart so as to define a deflection space 44 (FIGS. 3 and 5) therebetween. As a result, sound waves can be deflected into each of these deflection spaces 44 and then be deflected outwardly therefrom by the tapered inner and outer surfaces 37 and 38 as described hereinafter.

To allow for the passage of the fluid flow through the housing 12, the inner cones 36 have a diameter defined by the open base 41 which is smaller than the inside diameter of the housing 12. Preferably, the diameter of the inner cones 36 is similar to the diameter of the inlet tube 23 or outlet tube 26. Thus, when the inner cone assembly 18 is mounted in the interior chamber 16, the inner cones 36 are spaced radially inwardly from the inside surface 46 of the housing 12 such that an annular passage 47 is formed longitudinally along the length of the inner cone assembly 18. Since the passage 47 is formed outside of the inner cone assembly 18, the inner cones 36 themselves do not restrict fluid flow. While the fluid does enter the spaces 44 between the inner cones 36, the fluid pressure in these spaces 44 is believed to increase such that the flow of the fluid takes the path of least resistance which is along the passage 47.

Figure 4:
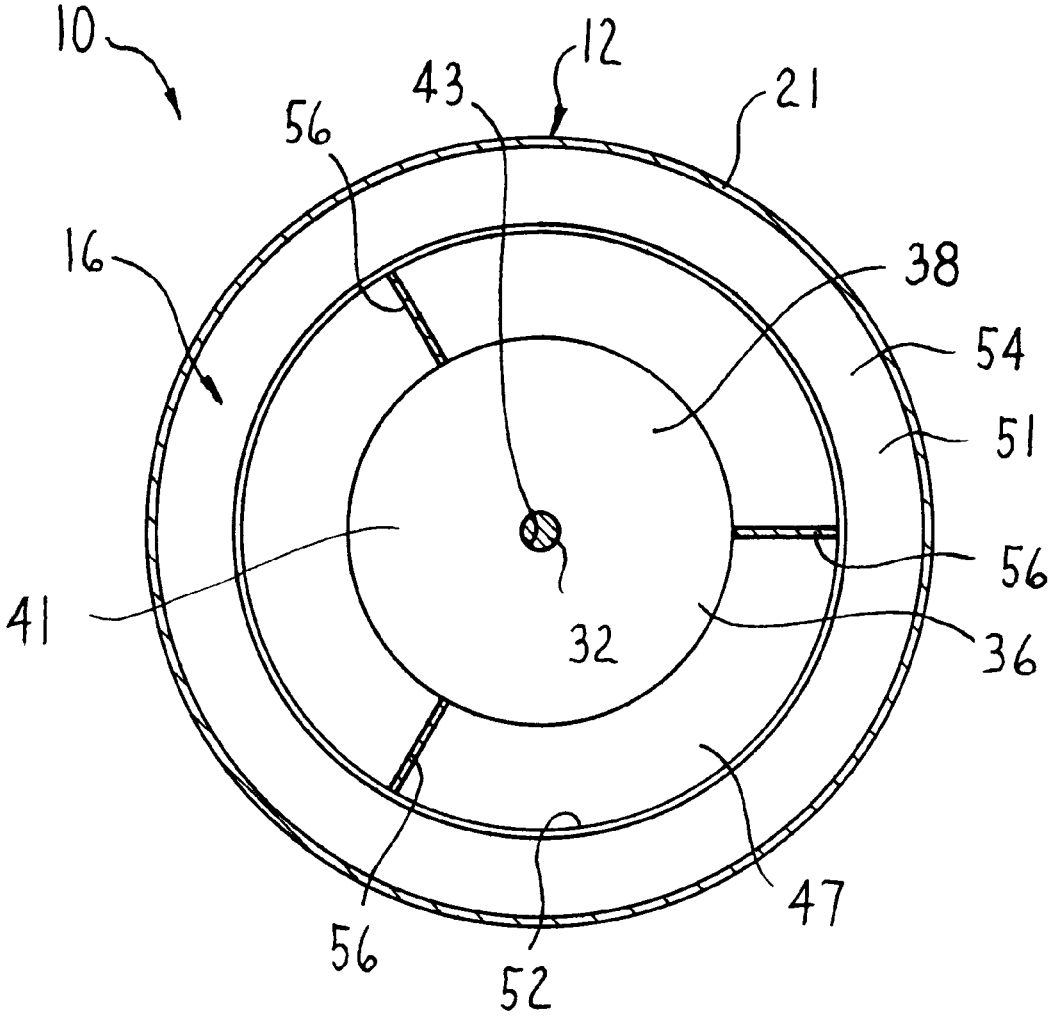
FIG. 4 is an end view in cross-section as taken along line 4—4 of FIG. 1.

In particular, since the area of this passage 47 is relatively large as seen in FIG. 4, the fluid flow is able to pass therethrough with minimal restriction which thereby prevents or at least minimizes undesirable increases in back pressure. By varying the dimensions of the inner cones 36 and the housing 12, the area of passage 47 can be increased or decreased to satisfy the back pressure requirements of particular engines or other noise sources. When this arrangement is used, for example on internal combustion engines for trucks, significant increases in gas mileage are achieved while sound levels are reduced to acceptable levels.

To further assist in the deflection of the sound waves as they pass into the interior chamber 16, the inside surface 46 of the housing 12 preferably is formed with an uneven shape so as to assist in deflecting sound waves radially inwardly and axially toward the inner cones 36. In particular, the inside housing surface 46 preferably includes a plurality of ring-like outer cones 51 which serve as tapered deflectors and are rigidly connected to the housing 12 in axially spaced relation. The outer cones 51 project transversely from the housing 12 so as to define transverse deflectors for the sound waves.

In particular, the outer cones 51 have an inner peripheral edge 52 which is spaced radially from the inner cones 36 to define the passage 47 therebetween. The outer cones 51 also have inner and outer surfaces 53 and 54 oriented transverse to the inside housing surface 46. Preferably, the inner and outer surfaces 53 and 54 taper radially inwardly toward the outlet 15 to define a frusto-conical shape for the outer cones 51. The inner surface 53 thereby deflects sound waves radially inwardly toward the inner cone assembly 18, while the outer surface 54 deflects the sound waves in the opposite radial direction toward the housing surface 46.

The combination of inner cones 36 and outer cones 51 thereby radially and axially deflect the sound waves numerous times along the housing 12 which is believed to cause destructive interference between the reflected waves and reduce the sound levels. While the outer cones 51 preferably are provided, the outer cones 51 can be eliminated such that the sound waves are deflected between the inner cone assembly 18 and the inside housing surface 46.

Further, while the inner cones 36 and outer cones 51 taper radially inwardly toward the outlet 15, the skilled artisan will appreciate that these cones 36 and 51 also can be reversed so as to taper in the opposite direction.

To support and protect the middle section of the inner cone assembly 18 from vibrations during use, a plurality of axially elongate strengthening ribs or plates 56 (FIGS. 2, 3 and 4) also are rigidly connected to the inner cone assembly 18 and are supported by the housing 12. The ribs 56 are angularly spaced apart as seen in FIG. 4 and extend radially outwardly from the open base 41 of the inner cones 36 to the inner peripheral edge 52 of the outer cones 51.

To direct the fluid flow and the sound waves into the longitudinal passage 47, the diverter arrangement 19 preferably defines a diverter passage 58 which extends between the inlet 14 and the passage 47. The diverter passage 58 preferably directs the sound waves into the passage 47 at an angle relative thereto to facilitate the deflection of the sound waves.

Figure 6:
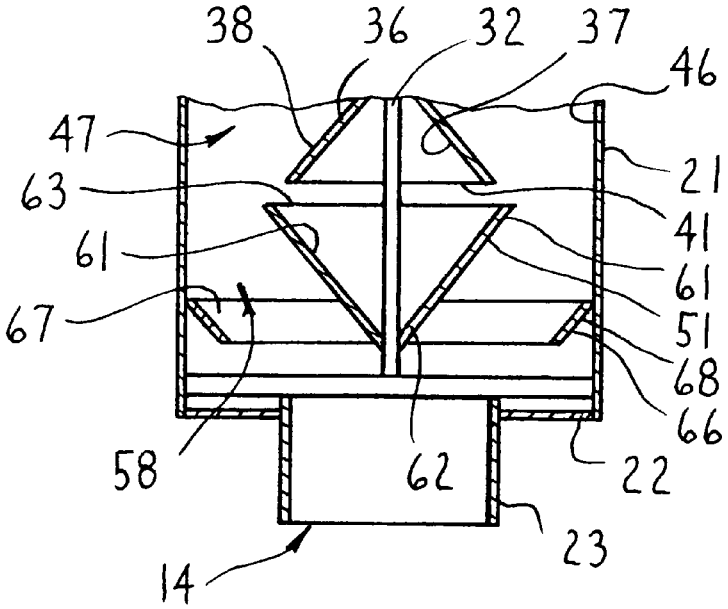
FIG. 6 is an enlarged partial view of the inlet end of the noise attenuating device of FIG. 3.

Referring to FIGS. 2, 3 and 6, the diverter arrangement 19 includes a diverter cone 59 which tapers radially outwardly away from the inlet 14 so as to divert the fluid flow and sound waves in a radially outward direction. The diverter cone 59 is formed as a cone without flare and preferably is hollow so as to define inner and outer surfaces 60 and 61 which taper radially outwardly away from the inlet 14. The diverter cone 59 therefore has a tip end 62 which is disposed proximate the inlet 14 and a larger open base 63 which opens downstream towards the inner cone assembly 18. Preferably, the open base 63 has a larger diameter than the inner cones 36 disposed adjacent thereto.

Accordingly, the outer surface 61 faces towards the inlet 14 to deflect the fluid flow and sound waves radially outwardly toward the longitudinal passage 47. The inner surface 60, however, faces towards the inner cones 36 and thereby functions to deflect the sound waves back towards the inner cones 36 and attenuate the sound levels.

The diverter cone 59 includes an aperture in the tip end 62 and is welded to the central support rod 32 the same as the inner cones 36. While both the inner cone assembly 18 and the diverter cone 59 are supported on the central support rod 32, it should be understood that separate support may be provided for each of the inner cone assembly 18 and the diverter cone 59.

The diverter arrangement 19 also includes a ring-like outer diverter cone 66 which is fixed to the housing 12 and generally encircles the tip end 62 of the diverter cone 59 in radially spaced relation therewith. The outer cone 66 has inner and outer surfaces 67 and 68 (FIG. 6) which taper radially inwardly toward the inlet 15 and define a frusto-conical shape for the outer cone 66. Preferably, the outer cone 66 has the same construction as the outer cones 51 although it is reversed so as to face in the opposite axial direction.

In particular, the inner diverter surface 67 faces towards the diverter cone 59 to thereby define the diverter passage 58 therebetween and deflect sound waves radially inwardly and axially toward the diverter cone 66. Since the inner diverter surface 67 extends radially inwardly away from the housing 12, the inner surface 67 prevents at least a portion of the deflected sound waves from traveling upstream to the end wall 22.

The noise attenuating device 10 and in particular, the above-described components thereof preferably are formed of metal although other suitable materials may be used so long as fluid flow is permitted and deflection of the sound waves can occur.

In use, the noise attenuating device 10 is attached to a noise source which generates sound waves. In particular, the noise source typically is an internal combustion engine (not illustrated), and the noise attenuating device 10 is connected to the exhaust pipe thereof. The internal combustion engine therefore not only generates a fluid flow, such as exhaust gas, but also generates sound waves which travel along the exhaust pipe.

The device 10 is connected to the exhaust pipe such that the fluid flow and sound waves are received into the inlet 14. The diverter arrangement 19 and specifically, the diverter cone 59 and outer cone 66 divert the fluid flow and sound waves radially outwardly to the longitudinal passage 47. Since the passage 47 has a relatively large area as seen in FIG. 4, the passage 47 does not cause excessive back pressures to be created as the fluid flows therethrough.

At the same time, the noise attenuating device 10 serves to attenuate sound levels by repeatedly deflecting the sound waves at least by the inner cone assembly 18, the outer cones 51 and the inside housing surface 46. In particular, the sound waves are repeatedly deflected radially inwardly and outwardly, and axially in the upstream and downstream directions. With respect to the inner cones 36 and outer cones 51, the sound waves are deflected into the hollow interiors thereof such as the deflection spaces 44 and around the exterior of these cones.

The interaction of the sound waves as they are deflected is believed to cause destructive resistance such that the sound levels are reduced. In particular, such destructive resistance is believed to occur when the sound waves are deflected by the curved surfaces of the inner cones 36 and the outer cones 51 wherein the sound waves are deflected as a straight line. Sound wave patterns thereby are formed by the deflected sound waves which act as resistance barriers to oncoming sound waves having like frequencies. As a result, the collision of the like sound waves causes destructive resistance to occur which thereby reduces the sound levels.

Figure 7:
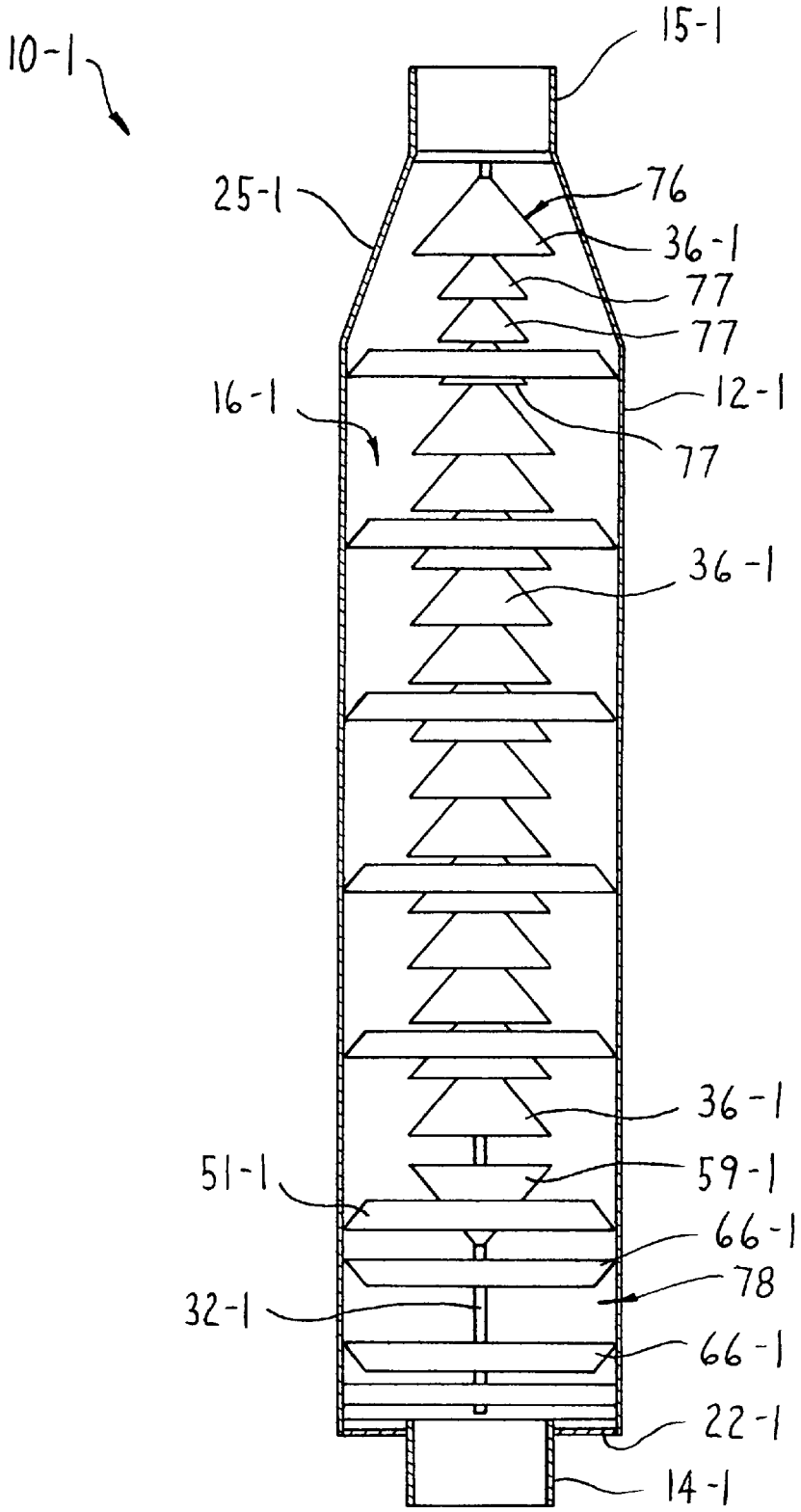
FIG. 7 is a front elevational view of a second embodiment of the noise attenuating device illustrating the housing in cross-section.

In an alternative embodiment illustrated in FIG. 7, a noise attenuating device 10-1 is provided which uses similar components as described above but in a different arrangement. Those components which are the same as those described above are identified with the same reference numeral further designated with a (-1) therewith, i.e. 12 and 12-1.

More particularly, the noise attenuating device 10-1 includes a housing 12-1 which defines an interior chamber 16-1 in communication with an inlet 14-1 and an outlet 15-1. An inner cone assembly 76 is provided which is formed substantially the same as the inner cone assembly 18 in that the assembly 76 includes a nested stack of inner cones 36-1 mounted on a central support rod 32-1. However, the inner cone assembly 76 also includes a plurality of smaller inner cones 77 near the inlet end thereof in the region of the converger cone 25-1.

The difference between the inner cones 77 and the inner cones 36 and 36-1 is the diameter. Otherwise the inner cones 77 are structurally and functionally the same as the inner cones 36 and 36-1 and thus, the previous discussion with respect to the inner cones 36 and 36-1 is applicable to the inner cones 77. Thus, the inner cone assembly 76 differs in that it uses a plurality of different sized inner cones 36-1 and 77 along the length thereof.

The noise attenuating device 10-1 also uses a diverter arrangement 78 which differs from the diverter arrangement 19. More particularly, the diverter arrangement 78 includes a diverter cone 59-1 and at least two outer cones 66-1.

The diverter cone 59-1 is spaced axially a greater distance from the inlet 14-1 than the diverter cone 59. For example, where the housings 12 and 12-1 have a 10 inch diameter, the diverter cone 59 is spaced approximately ¾ inch from the end wall 22 while the diverter cone 59-1 is spaced approximately 6 inches from the end wall 22-1. The two outer cones 66-1 are spaced upstream of the diverter cone 59-1 between the diverter cone 59-1 and the inlet 14-1. This arrangement 10-1 also is usable to attenuate sound levels and facilitate fluid flow.

By varying the positions of the diverter cones 59 and 59-1 and outer cones 66 and 66-1, the distance which the sound waves of different frequencies travel along the housing 12 can be varied. Thus, the sound waves can be prevented from passing out or leaking out of the housing 12 before the sound levels have been attenuated.

While the noise attenuating device 10 and 10-1 is typically are used on exhaust pipes for internal combustion engines, these devices 10 and 10-1 also are useable on additional sound sources which generate a fluid flow. For example, the devices 10 and 10-1 can be used on an air compressor intake module, a vacuum cleaner intake module, fans and the like.

Alternatively, while the embodiments of FIGS. 1–7 preferably are used to muffle exhaust, the noise attenuating devices 10 and 10-1 also can be used in combination with a noise source which does not generate a fluid flow. Rather, sound waves such as those produced by motors, jack hammers or the like can be directed into the devices 10 or 10-1 wherein the inner cone assemblies 10 or 76 function to reduce sound levels as described previously.

Further, while the sound attenuating devices 10 or 10-1 typically are used in a gas wherein the sound waves travel through the gas, these sound attenuating devices 10 or 10-1 also can be adapted for use with any free or held medium or fluid such as a liquid wherein the medium can enter the interior chamber 16 or 16-1 and sound waves are able to travel therethrough.

Still further, the skilled artisan will appreciate that a plurality of inner cone assemblies 18 or 76 can be provided, or a plurality of the devices 10 or 10-1 can be joined together in series or in parallel. Further, the number of inner cones 36 and 36-1 and outer cones 54 and 54-1, and the overall length of the devices 10 and 10-1 also can be varied as the skilled artisan will appreciate. Thus, by varying the arrangement and dimensions of the above-described components, the skilled artisan can readily adapt the noise attenuating devices 10 or 10-1 to different noise sources.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A noise attenuating device for attenuating sound levels comprising:

an elongate housing which defines a hollow interior chamber and includes an inlet and an outlet in communication with said interior chamber;

an inner cone assembly which includes support means for supporting said inner cone assembly in said interior chamber, said inner cone assembly comprising a plurality of inner cones which taper radially inwardly from a base end to a tip end thereof, said inner cones being arranged in end-to-end relation such that said inner cones taper radially inwardly toward said outlet and define an elongate stack of said inner cones which extends longitudinally through said housing, said inner cones being axially spaced apart to define a deflector space between each adjacent pair of said inner cones, said housing being spaced radially outwardly away from said inner cones to define a longitudinal passage defined outwardly of said inner cone assembly, said longitudinal passage being in communication with said inlet and said outlet to define a flow path extending through said housing; and diverter means disposed proximate said inlet which defines a deflector passage in communication with said inlet and said longitudinal passage for deflecting sound waves into said longitudinal passage and toward said inner cone assembly.

2. A noise attenuating device according to claim 1, which includes a plurality of frusto-conical outer cones which project radially inwardly from said housing within said interior chamber such that said outer cones taper toward said outlet, said outer cones defining deflector surfaces oriented transverse to said housing to deflect said sound waves toward said inner cone assembly.

3. A noise attenuating device according to claim 1, wherein said diverter means comprises a diverter cone which tapers radially inwardly toward said inlet to divert said sound waves radially outwardly from said inlet to said longitudinal passage.

4. A noise attenuating device according to claim 1, wherein said tip end of each of said inner cones projects into said base end of an adjacent one of said inner cones such that said inner cones are nested together in spaced relation.

5. A noise attenuating device according to claim 2, wherein said outer cones taper radially inwardly away from said inlet.

6. A noise attenuating device according to claim 3, wherein said longitudinal passage is an annular space which is defined between said housing and said inner cones and extends longitudinally between said inlet and said outlet.

7. A noise attenuating device according to claim 1, wherein said deflector space is defined between an outer surface of an upstream one of said inner cones and an opposing inner surface of a downstream one of said inner cones.

8. A noise attenuating device according to claim 7, wherein each said opposing inner and outer surfaces are substantially parallel to each other.

9. A noise attenuating device according to claim 1, wherein said inner cones have substantially equal diameters.

10. A noise attenuating device for attenuating sound waves of a fluid flow comprising:

an elongate housing which defines a hollow interior chamber and includes an inlet and an outlet in communication with said interior chamber to permit said fluid flow to pass therethrough;

an inner cone assembly supported on said housing within said interior chamber, said inner cone assembly comprising a plurality of inner cones having inner and outer surfaces which taper radially inwardly from an open base end to a tip end of each said inner cone, said inner cones being arranged in end-to-end relation wherein each said base end faces in an upstream direction toward said inlet and each said tip end of an upstream one of said inner cones is disposed proximate said base end of a downstream one of said inner cones, said inner cones defining an elongate stack which extends longitudinally through said housing, said inner cones being axially spaced apart to define a deflector space between said outer surface of an upstream one of said inner cones and said inner surface of a downstream one of said inner cones; and said housing being spaced radially outwardly away from said inner cones to define a generally annular passage which is defined outwardly of said inner cone assembly and extends longitudinally between said inlet and outlet such that said fluid flow flows substantially through said longitudinal passage.

11. A noise attenuating device according to claim 10, which includes a deflector which is disposed proximate said inlet and includes a deflector surface facing towards said inlet, a deflector passage being defined by said deflector surface and said housing wherein said deflector passage extends between said inlet and said longitudinal passage, said deflector directing said fluid flow generally radially through said deflector passage such that said fluid flow is directed into said annular passage and flows longitudinally therethrough and sound waves generated by said fluid flow deflect from said housing toward said inner cone assembly for attenuating said sound waves.

12. A noise attenuating device according to claim 11, wherein said deflector is defined by an inlet cone which tapers radially outwardly away from said inlet.

13. A noise attenuating device according to claim 10, which includes a conical outlet surface proximate said outlet which tapers radially inwardly toward said outlet such that said fluid flow converges radially inwardly from said longitudinal passage to said outlet.

14. A noise attenuating device according to claim 10, wherein said tip end of each of said inner cones projects partially into said base end of an adjacent one of said inner cones such that said inner cones are nested together in spaced relation.

15. A noise attenuating device according to claim 14, wherein said inner cones are imperforate.

16. A noise attenuating device according to claim 10, which includes a plurality of frusto-conical outer cones which are longitudinally spaced apart along said longitudinal passage and project radially inwardly from said housing toward said outlet, said outer cones defining deflector surfaces which are oriented transverse to said housing and generally face in an upstream direction to deflect said sound waves toward said inner cone assembly, said longitudinal passage being defined radially between said outer cones and said inner cones.

17. A noise attenuating device for attenuating sound waves of a gas flow comprising:

a housing which defines a hollow interior chamber and includes an inlet and an outlet in open communication with said interior chamber to permit passage of a gas flow longitudinally therethrough;

an inner deflector assembly within said interior chamber comprising a stack of inner deflectors which extends longitudinally through said housing, each of said inner deflectors having inner and outer surfaces which taper inwardly from an open base end to a tip end, said inner deflectors being arranged in end-to-end relation to define said stack wherein said base ends face in an upstream direction toward said inlet and each said tip end of an upstream one of said inner deflectors is disposed proximate said base end of a downstream one of said inner deflectors, said inner deflectors being axially spaced apart to define a deflector space between said outer surface of an upstream one of said inner deflectors and said inner surface of a downstream one of said inner deflectors;

said inner deflectors being spaced inwardly away from said housing to define a generally annular passage which is defined outwardly of said inner cone assembly and extends longitudinally between said inlet and outlet; and said inlet directing said gas flow into said longitudinal passage such that said gas flow passes through said longitudinal passage and sound waves of said gas flow are directed inwardly toward said inner deflectors and into said deflector spaces.

18. A noise attenuating device according to claim 17, wherein said inlet includes an inlet deflector which is disposed proximate said inlet and includes a deflector surface facing towards said inlet, a deflector passage being defined by said deflector surface and said housing wherein said deflector passage extends between said inlet and said longitudinal passage, said inlet deflector directing said gas flow generally through said deflector passage such that said gas flow is directed into said annular passage and said sound waves are directed outwardly toward said housing which are thereby deflected inwardly towards said inner deflectors.

19. A noise attenuating device according to claim 17, wherein said inner deflectors are concentric cones.

20. A noise attenuating device according to claim 17, wherein said housing includes an inner peripheral surface which faces inwardly toward said inner deflector assembly and defines said annular passage therebetween, said inner peripheral surface extending substantially parallel to a longitudinal axis of said housing.

* * * * *